United States Patent [19]

Kodera et al.

[11] Patent Number: 4,949,565

[45] Date of Patent: Aug. 21, 1990

[54] DISTORTION STRAIGHTENING METHOD

[75] Inventors: Nobukazu Kodera, Kodaira; Takeo Kakuti, Chofu, both of Japan

[73] Assignee: Kabushiki Kaisha Toshiba, Kawasaki, Japan

[21] Appl. No.: 330,618

[22] Filed: Mar. 30, 1989

[30] Foreign Application Priority Data

Mar. 31, 1988 [JP] Japan ..... 63-78516

[51] Int. Cl.[5] ..... B21D 37/00

[52] U.S. Cl. ..... 72/10; 72/17; 72/34; 72/381; 72/383; 72/389; 72/701

[58] Field of Search ..... 72/381, 380, 383, 385, 72/389, 6, 8, 9, 10, 17, 30, 34, 701, 702

[56] References Cited

U.S. PATENT DOCUMENTS

| | | | |
|---|---|---|---|
| 3,949,588 | 4/1976 | Seo | 72/389 |
| 4,144,730 | 3/1979 | Judge, Jr. | 72/389 |
| 4,154,073 | 5/1979 | Galdabini | 72/389 |

FOREIGN PATENT DOCUMENTS

| | | | |
|---|---|---|---|
| 2452435 | 5/1976 | Fed. Rep. of Germany | 72/34 |
| 0186123 | 8/1986 | Japan | 72/30 |
| 0255720 | 11/1986 | Japan | 72/34 |
| 0144822 | 6/1988 | Japan | 72/34 |
| 0848119 | 7/1981 | U.S.S.R. | 72/30 |
| 1013018 | 4/1983 | U.S.S.R. | 72/34 |

*Primary Examiner*—David Jones

*Attorney, Agent, or Firm*—Foley & Lardner, Schwartz, Jeffery, Schwaab, Mack, Blumenthal & Evans

[57] ABSTRACT

A straightening method particularly for an elongated metal member having a long longitudinally linear length, is carried out by an automatic straightening apparatus by the manner of preliminarily setting a plurality of points at which distortion are to be straightened. When it is required to straighten an amount of distortion to be straightened at a certain point, the amount is adjusted in consideration of the amounts of strains to be straightened at the other points by utilizing the method of least squares so that the elongated metal member has substantially a linearly straight shape. According to this manner, the amounts of the respective points of the long member to be straightened are adjusted. The distortion of the elongated metal member can thus be substantially straightened to a highly improved accuracy.

4 Claims, 4 Drawing Sheets

DISTORTION STRAIGHTENING METHOD

BACKGROUND OF THE INVENTION

This device relates to a distortion straightening method of a distortion straightening device to straighten distortion in long metal members.

Generally, during the process of cutting metallic members such as guide rails, having a relatively long longitudinally linear length, merely referred to as long members hereinafter, to a predetermined dimension, an oxide film remains on the surface of the long member if bending and other forms of distortion are not within the allowable values. Accordingly, it is necessary to measure the distortion to determine whether or not it is within the allowance before the cutting working of the long member, and to correct or remedy the distortion of the long member to be within the allowance by using a hydraulic press means, for example.

An automatic press-type straightening (i.e. strain correcting) apparatus for correcting the strain of a long metallic members is shown in FIG. 3 in perspective view. Referring to FIG. 3, the automatic straightening apparatus comprises a unit 1 for measuring the degree of straightness of the long member to be measured. A plurality of conveying rollers 3 are disposed at proper intervals on and along one side of a guide rail 2 for the straightness measuring unit 1 in a manner so that the rotation shafts of the rollers 3 are normal to the direction in which the guide rail 2 extends. Positioning rollers 5 for positioning the long member 4 at the measuring time thereof are arranged in the vicinity of the conveying rollers 3, respectively. A plurality of rotating rollers 6 are also arranged between the adjacent conveying rollers 3 on and along one side of the guide rail 2 to rotate the metallic long member by about 90°. A distortion straightening station 7 provided with a portion for carrying out the pressing operation for the long metal member 4 is disposed at one end portion of the arrangement of the conveying rollers 3 and the rotating rollers 6. A plurality of other conveying rollers 8 are also disposed at proper intervals on the same side as those of the conveying rollers 3, with the distortion straightening station 7 interposed between the arrangements of the conveying rollers 3 and 8, and the conveying rollers 8 acting to subsequently convey the long metal member 4 pressed during the passing through the distortion straightening station 7. A plurality of rotating rollers 9 are also disposed between the adjacent conveying rollers 8 for rotating the long metal member 4 by about 90°.

The conveying rollers 3, the rotating rollers 6, the pressing portion of the distortion straightening station 7, the conveying rollers 8, and the rotating rollers 9 are arranged in alignment with each other for linearly conveying the long metal member 4 therealong in this order.

The long metal member 4 mounted on the conveying rollers 3 is conveyed to a predetermined position by rotation of the conveying rollers 3, and the long member 4 is positioned by the positioning rollers 5 at a portion at which the measuring of the member 4 is carried out. After the positioning of the long member 4 at the predetermined position, the straightness measuring unit 1 is moved on and along the guide rail 2 to thereby measure the strain of the long member 4 during the movement thereon. The measured data is input as electrical signals into a control board 10 located at a suitable portion in the vicinity of the distortion straightening apparatus.

After the completion of the measuring process of the measuring unit 1, the conveying rollers 3 are rotated to convey the long metal member 4 to the distortion straightening station 7. The long member 4 is subjected to the straightening of the distortion in response to electric signals from the control board 10 and the long member 4 for which the distortion has been straightened, and is then conveyed towards the conveying rollers 8. The long member 4, the strains of which have been once corrected, is conveyed back towards the distortion measuring unit 1 by the reverse rotations of the conveying rollers 3 and 8 to again measure the distortion in the long member 4. If distortion of the long member 4 is detected during this repeated measurement, the long member 4 is again conveyed by the rotation of the conveying rollers 3 and 8 to the distortion straightening station 7 to correct the strains in the manner described above. On the contrary, if no distortion is detected during the repeated measurement, the long member 4 is conveyed as it is by the rotation of the conveying rollers 3 and 8 and then conveyed out from the end arrangement of the conveying rollers 8.

A distortion straightening or straightening process to be carried out at the distortion straightening station 7 will be described hereunder with reference to FIGS. 4 to 7.

As illustrated in FIG. 4, one set of press heads **11*a*, 11*b* and 11*c* are disposed in the distortion straightening station 7 to be parallel to each other and the front ends thereof are directed to the same direction, and the other set of press heads 12*a*, 12*b* and 12*c* are also disposed at the distortion straightening station 7 to be parallel to each other and the front ends thereof directed in the same directions. These press heads 11*a*, 11*b*, 11*c*, and 12*a*, 12*b*, 12*c* are disposed in opposing arrangement in the order shown in FIG. 4 with the metallic long member 4 interposed therebetween. These press heads 11 and 12** are independently movable.

FIG. 5 illustrates the so-called "plus bending" operation. Referring to FIG. 5, the long metal member 4 is supported at two portions by the press heads **12*a* and 12*c* and the central portion between these supported portions of the long member 4 is as viewed downwardly, pressed by the press head 11*b* to carry out the straightening process for the long member 4. FIG. 6 illustrates the so-called "minus bending" operation. Referring to FIG. 6, the long metal member 4 is supported by one press head 12*b* and two portions on both sides of the press head 12*b* are downwardly pressed by the press heads 11*a* and 11*c* to carry out the straightening operation for the long member 4. FIG. 7 illustrates a bidirectional pressing operation in which FIG. 7, the long metal member 4 is pressed at three portions by the press heads 11*a*, 12*b* and 11*c* to carry out the straightening operation for the long member 4**.

These straightening, i.e. distortion straightening, methods described above are conventionally known and carried out, and particularly, the plus bending method has been usually adopted as a highly desirable method.

One of the conventional straightening methods referred to above, i.e. the minus bending operation, by utilizing the automatic straightening apparatus of the type described hereinbefore will be now described in detail with reference to FIG. 8.

The amounts s of the distortions of a metallic long member 4 are subsequently measured for each preset correction span value 1 and the measured data is input to the control board as electrical signals. When the measured distortion amount s of a certain portion of the long member 4 exceeds the predetermined reference value, the portion is determined as a portion to undergo distortion straightening and the measured distortion amount s at that portion is determined as the amount of straightening. The strain of the metallic long member 4 is then strain-corrected in the strain correcting station 7 in accordance with the data input into the control board 10.

However, with the straightening method described above, the value of the distortion of the long member for every correction span is regarded as the amount of distortion to be corrected. According to this method, the distortion may be partially corrected at respective portions of the long member to be measured, but not totally throughout the whole length thereof. In a certain case, the long member may not be totally corrected to be straight throughout the whole length thereof. In another case wherein the long member to be straightened has a totally smooth and gentle distortion, i.e. a curve, the portions to have their distortion straightened may not be detected as distortion straightening portions by the use of the conventional method of detecting the portions to be corrected.

SUMMARY OF THE INVENTION

An object of this invention is to substantially eliminate the defects of the conventional technique and to provide an improved method of straightening metal members having relatively long longitudinal length, in consideration of the entire shape of the long member, so as to substantially straighten distortion of the long member so that the linear shape of the long metal member approaches that of a primary straight line.

This and other objects can be achieved according to this invention by providing a straightening method for a long metal member having a long longitudinal length, by utilizing a straightening apparatus comprising the steps of:

preliminarily measuring of a plurality of points at which distortion are to be straightened;

calculating an amount of distortion to be straightened at a certain one point of said plural points in consideration of amounts of distortions to be straightened at the other points so that the long metal member has substantially a linearly straight shape; and straightening the distortion at said one point of the long member in accordance with the adjusted amounts of the distortions to be straightened at other points.

In the best mode of the invention, the adjusted step is performed by utilizing a method of least squares so that the linearly straight shape of the metallic long member substantially approaches that of a primary straight line.

According to the straightening method of this invention, a plurality of points of a long metal member at which distortions thereof are to be straightened, are preliminarily set. When it is required to straighten an amount of distortion to be straightened at a certain point, the amount is set in consideration of amounts of distortions to be straightened at the other points by utilizing the method of least squares so that the long metal member has substantially a linearly straight shape. According to this manner, the amounts of distortions to be straightened for the respective points of the long member are set. The straightening accuracy of the apparatus can thus be remarkably improved.

The preferred embodiment described according to this invention will be described further in detail hereunder, with reference to the accompanying drawings.

DESCRIPTION OF THE PREFERRED EMBODIMENT

Figure 3:
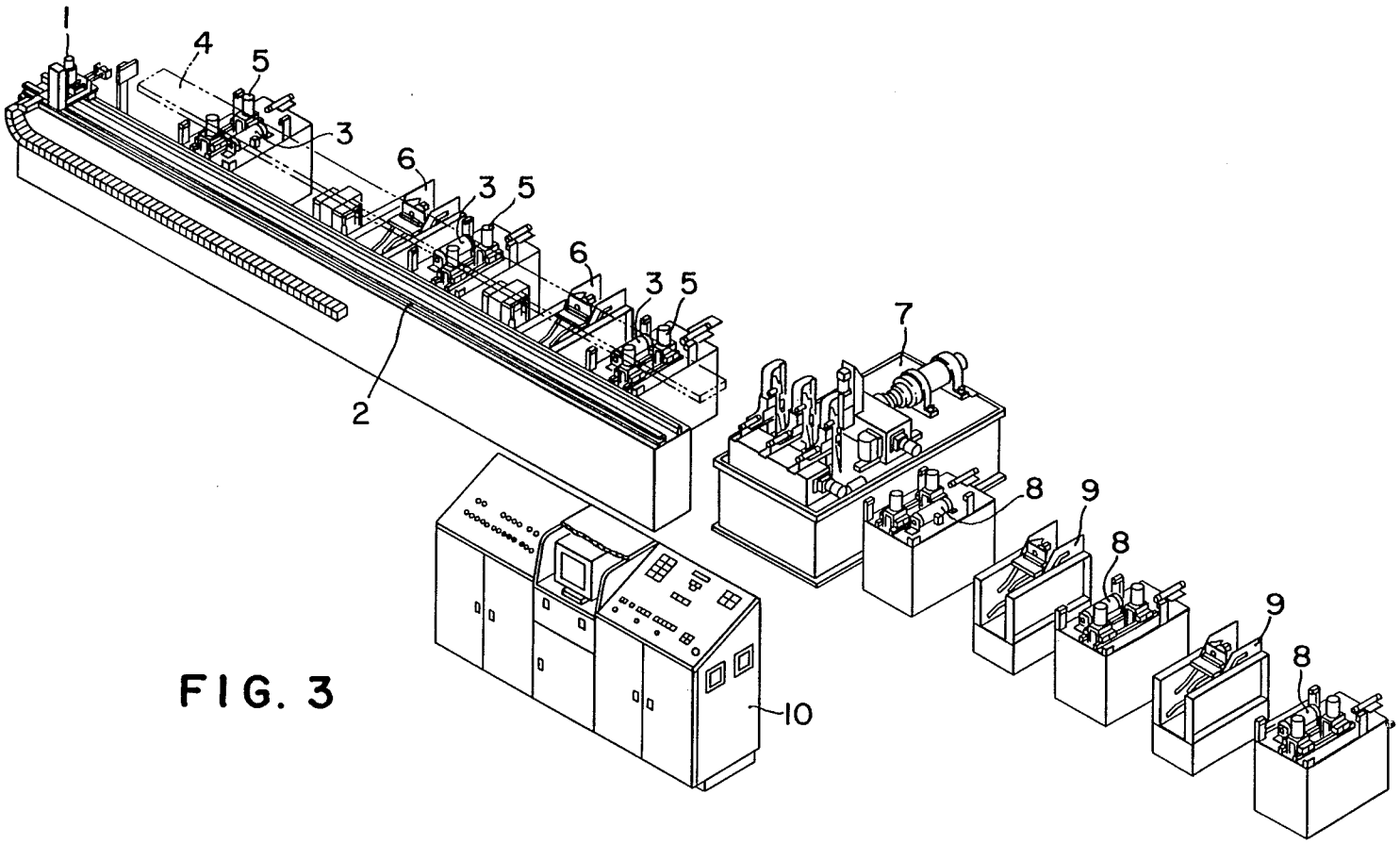
FIG. 3 is a perspective general view of a press-type straightening apparatus for carrying out the straightening method according to this invention.
Figure 4:
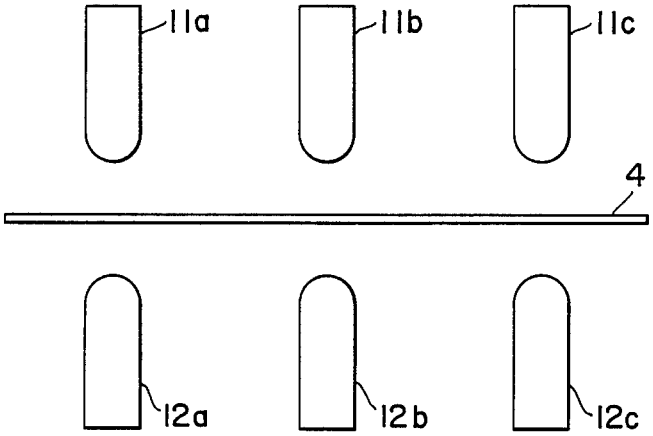
FIG. 4 is an illustration showing the basic arrangement of press heads of the straightening apparatus shown in FIG. 3 for carrying out the press bending operations to the metallic long member.
Figure 5:
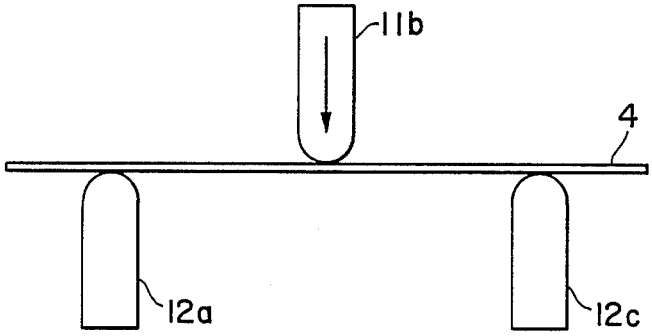
FIGS. 5, 6 and 7 are illustrations showing the arrangements of the press heads for carrying out plus bending operation, minus bending operation and bidirectional bending operation, respectively.
Figure 6:
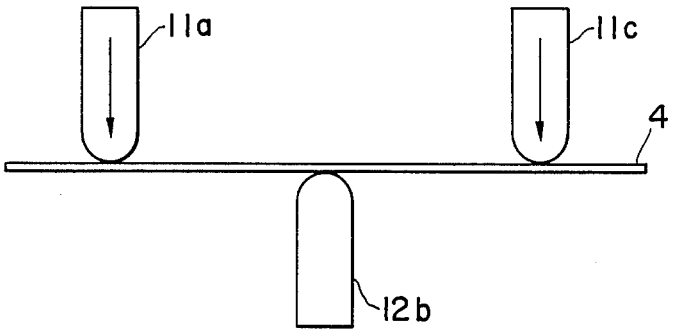
Figure 7:
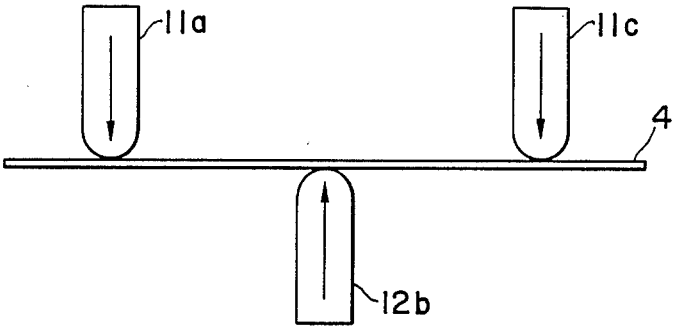
Figure 8:
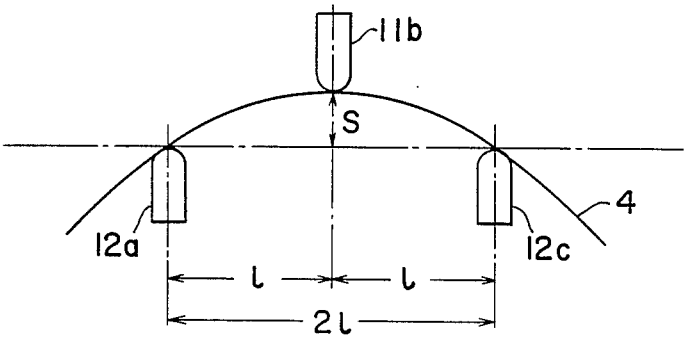
FIG. 8 PRIOR ART
FIG. 8 is an illustration showing the arrangement of the press heads for carrying out a conventional straightening method to a long metal member.

A method of straightening a long metal member according to this invention is carried out by using an automatic straightening apparatus of the type shown in FIG. 3 and which has been previously described herein. The details of the straightening apparatus are therefore eliminated hereunder.

Figure 1:
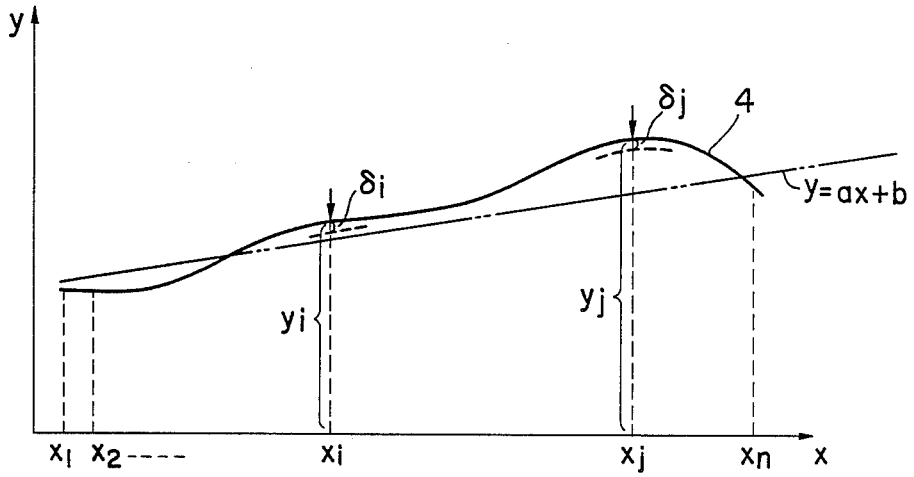
FIG. 1 is a graph representing a basic principle of a straightening method according to this invention.

FIG. 1 shows one example of a long metal member 4, the distortions of which have already been measured, and in FIG. 1, the long member 4 is positioned in the x-y coordinate system. The x-axis represents the sampling points at which the distortions are measured and the y-axis represents the amounts of the distortions. In the following, a distortion straightening, i.e. straightening, method will be applied to a case where the shape of the long member 4 in the illustrated x-y coordinate system is straightened to a shape substantially represented by a straight line, shown by an equation $y=ax+b$ representing a primary straight line.

Now, providing that a deformed amount of the long member to be straightened at a sampling point $x_i$ is defined as $\delta_i$, the strain at the sampling point $x_i$ after the correction will be expressed as $(y_i-\delta_i)$ in the illustrated coordinate system.

Figure 2:
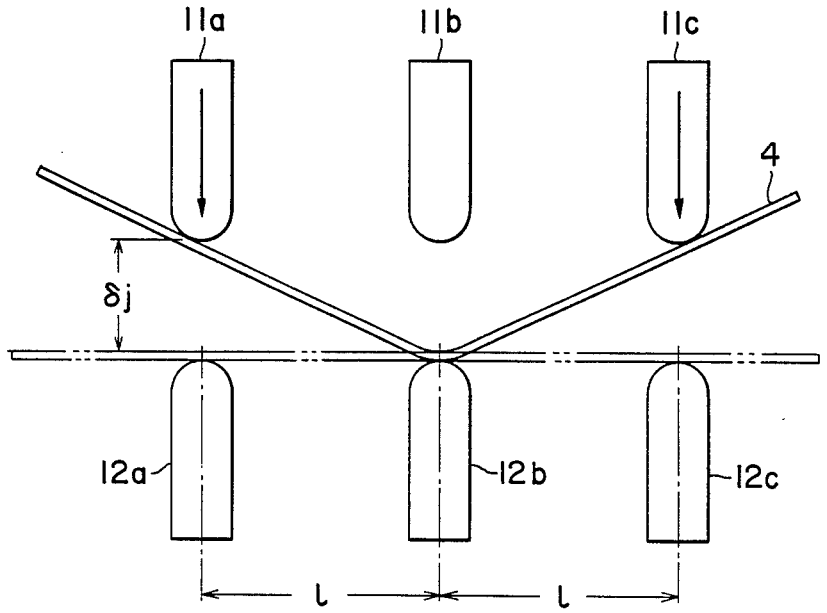
FIG. 2 is an illustration which is explanatory the straightening method for a long metal member in accordance with a press bending operation.

Next, the description will be made hereunder with respect to the influence of the straightening operation at the sampling point $x_j$ other than the sampling point $x_i$ to the distortion to be given to the point $x_i$. The straightening method according to this embodiment is carried out on the basis of the minus bending operation as shown in FIG. 2. Providing that the straightening amount at the sampling point $x_j$ is defined as $\delta_j$ and the distortion straightening of the amount $6_j$ is now made, the sampling point $x_j$ of the long member 4 is supported by a press head 12*b* and the long member 4 is pressed downwardly, as viewed, by press heads 11*a* and 11*c* on both the side points of the point $x_j$ to straighten the distortion $6_j$ of the long member 4. The straightening amount per a unit length of the long member 4 is expressed as ($\delta_j/l$). Accordingly, the influence of the straightening operation at the sampling point $x_j$ to the strain at the point $x_i$ is expressed as $$|x_i - x_j| \cdot \delta_j/l.$$

wherein the symbol l represents the interval between the mutually adjacent press heads, i.e. half length of the correction span. Therefore, the influences of the distortions to be straightened at all of the sampling points of the long member 4 to the sampling point $x_i$ are represented as $$\sum_{j=1}^{n} |x_i - x_j| \cdot \delta_j/l$$

and the distortion of the point $x_i$ of the long member after the straightening at all the points is expressed as $$y = y_i + \sum_{j=1}^{n} |x_i - x_j| \cdot \delta_j/l \quad (1)$$

The distortion amount $\delta_i$ to be straightened is a value to be straightened at one sampling point $x_i$ so that the equation (1) is substantially in accordance with the ideal equation $y = ax + b$.

One example for calculating the amount $\delta_i$ will be described hereunder.

When an error between the shape of the long member 4 after the straightening at the sampling point $x_i$ and the shape represented by the equation $y = ax + b$, is referred to as the error $\epsilon_i$, which is expressed as $$\epsilon_i = y_i + \sum_{j=1}^{n} |x_i - x_j| \cdot \delta_j/l - (ax_i + b) \quad (2)$$

the method of least squares is applied to the equation (2) to obtain the square-sum E of the error $\epsilon_i$ at the point $x_i$, the square-sum E is expressed as $$\begin{aligned} E &= \sum_{j=1}^{n} \epsilon_i^2 \\ &= \sum_{j=1}^{n} \{y_i + \Sigma|x_i - x_j| \cdot \delta_j/l - (ax_i + b)\}^2 \end{aligned} \quad (3)$$

In this equation (3), to make the value E minimum is achieved by calculating values of $\delta_k$, a, and b satisfying the following equations (4).

$$\frac{\partial E}{\partial \delta_k} = 0 \ (k = 1, 2, 3, \ldots, n-1, n), \quad (4)$$

$$\frac{\partial E}{\partial a} = 0, \frac{\partial E}{\partial b} = 0,$$

The solution of the equation (4) is arranged as the following matrix (5).

$$(A_{kj}) \begin{pmatrix} \delta_1 \\ \delta_2 \\ \cdot \\ \cdot \\ \cdot \\ \delta_{n-1} \\ F_n \\ a \\ b \end{pmatrix} = (K_k) \quad (5)$$

The respective elements of the matrix (5) can then be expressed as follows.

$$A_{kj} = -\sum_{i=1}^{n} \frac{|x_i - x_j|\ |x_i - x_k|}{l^2} \quad \begin{pmatrix} k = 1, 2, \ldots, n-1, n \\ j = 1, 2, \ldots, n-1, n \end{pmatrix}$$

$$A_{k(n+1)} = \sum_{i=1}^{n} \frac{|x_i - x_k|}{l} x_i \quad (k = 1, 2, \ldots, n-1, n)$$

$$A_{k(n+2)} = \sum_{i=1}^{n} \frac{|x_i - x_k|}{l} \quad (k = 1, 2, \ldots, n-1, n)$$

$$A_{(n+1)j} = -\sum_{i=1}^{n} \frac{|x_i - x_j|}{l} x_i \quad (j = 1, 2, \ldots, n-1, n)$$

$$A_{(n+2)j} = -\sum_{i=1}^{n} \frac{|x_i - x_j|}{l} \quad (j = 1, 2, \ldots, n-1, n)$$

$$A_{(n+1)(n+1)} = \sum_{i=1}^{n} x_i^2$$

$$A_{(n+1)(n+2)} = A_{(n+2)(n+1)} = \sum_{i=1}^{n} x_i$$

$$A_{(n+2)(n+2)} = n$$

$$K_k = \sum_{i=1}^{n} \frac{|x_i - x_k|}{l} y_i \quad (k = 1, 2, \ldots, n-1, n)$$

$$K_{(n+1)} = \sum_{i=1}^{n} x_i y_j$$

$$K_{(n+2)} = \sum_{i=1}^{n} y_j$$

In the described equations of the matrix, the values of $x_i$, $y_i$ and l are known as measured data, so that the equations constitute simultaneous equations of (n+2) dimensions with respect to the value $\delta_1, \delta_2, \ldots \delta_{n-1}, \delta_n$, a, and b. These values can thus be obtained by solving the simultaneous equations. Accordingly, the distortion of long metal member can be straightened throughout the whole length thereof in accordance with the values $\delta_1, \delta_2, \ldots \delta_{n-1}, \delta_n$, which are the amounts to be straightened at the corresponding points $x_1, x_2, \ldots x_{n-1}, x_n$ of the long metal member.

We claim:

1. A method of straightening an elongated metal member comprising the steps of:

(a) preliminarily setting a plurality of points at which distortion of said elongated metal member from a substantially linearly straight shape are to be straighten;

(b) calculating an amount of distortion to be straightened at a first one of said plural points in consideration of the amounts of distortions to be straightened at the remaining points so as to give said elongated metal member said substantially linearly straight shape; and (c) straightening the distortion at said first point of said elongated metal chamber in accordance with the amounts of the distortions to be straightened at said remaining points.

2. A method of straightening according to claim 1, wherein said calculating step comprises the steps of:

(i) measuring the distortions of said elongated metal member at each of said plurality of points; and (ii) determining a primary straight line representing a linearly straight shape of said elongated metal member, using a line-fitting operation comprising the use of said measured distortions in the method of least squares to determine said primary straight line.

3. A method of straightening according to claim 1, wherein:

said distortion straightening step is carried out in accordance with a three portions press bending operation in respect to said elongated metal member, in which said elongated metal member is placed between three sets of oppositely arranged press heads of said straightening apparatus and in which at least one of said press heads is moved to effect straightening of the distortion at said one point.

4. A method of straightening according to claim 1, wherein the amounts of distortions to be straightened at said plural points are measured and detected as electrical signals and the amount of distortion to be actually straightened at said one point is calculated in response to the thus detected electrical signals.

* * * * *